United States Patent [19]

Webber

[11] 4,000,626

[45] Jan. 4, 1977

[54] LIQUID CONVECTION FLUID HEAT EXCHANGER FOR REFRIGERATION CIRCUIT

[76] Inventor: Robert C. Webber, 13 Bay Colony Lane, Ft. Lauderdale, Fla. 33308

[22] Filed: Feb. 27, 1975

[21] Appl. No.: 553,559

[52] U.S. Cl. ..... 62/175; 62/197; 62/335

[51] Int. Cl.[2] ..... F25B 7/00; F25B 41/00

[58] Field of Search ..... 62/197, 198, 335, 175, 62/510, 513, 196 R, 195, 79

[56] References Cited

UNITED STATES PATENTS

| | | | |
|---|---|---|---|
| 830,613 | 9/1906 | Pictet | 62/335 |
| 2,388,556 | 11/1945 | Lathrop | 62/197 |
| 2,680,956 | 6/1954 | Haas | 62/335 |
| 2,707,869 | 5/1955 | Dennison | 62/175 |
| 2,718,764 | 9/1955 | Kramer | 62/197 |
| 2,794,328 | 6/1957 | Herrick | 62/198 |
| 2,867,094 | 1/1959 | Herrick | 62/196 R |
| 3,301,002 | 1/1967 | McGrath | 62/175 |

*Primary Examiner*—Lloyd L. King
*Attorney, Agent, or Firm*—Jenkins, Hanley & Coffey

[57] ABSTRACT

In a phase-change refrigeration circuit including a compressor, condenser and evaporator and connecting conduits all charged with a phase-change refrigerant, each of the compressor, condenser and evaporator having an input and output, the improvement comprising a heat exchanger including a container filled with a liquid convection fluid with the container enclosing a portion of the circuit such that the convection fluid is in heat-conducting relation to the system refrigerant flowing through the said enclosed portion. One such heat exchanger filled with convection fluid may be disposed between the compressor and the condenser of the system to enclose the conduit extending therebetween. Another such heat exchanger container filled with convection fluid may be used to enclose the evaporator of a high-stage circuit and the condenser of the low-stage circuit, the high-stage and low-stage being cascaded together. Additional by-passing conduits may be provided to by-pass either the condenser or the evaporator of the circuit and a portion of the by-pass conduit means may be in heat-conducting relationship to the convection fluid in the heat exchanger.

10 Claims, 3 Drawing Figures

LIQUID CONVECTION FLUID HEAT EXCHANGER FOR REFRIGERATION CIRCUIT

Figure 1:
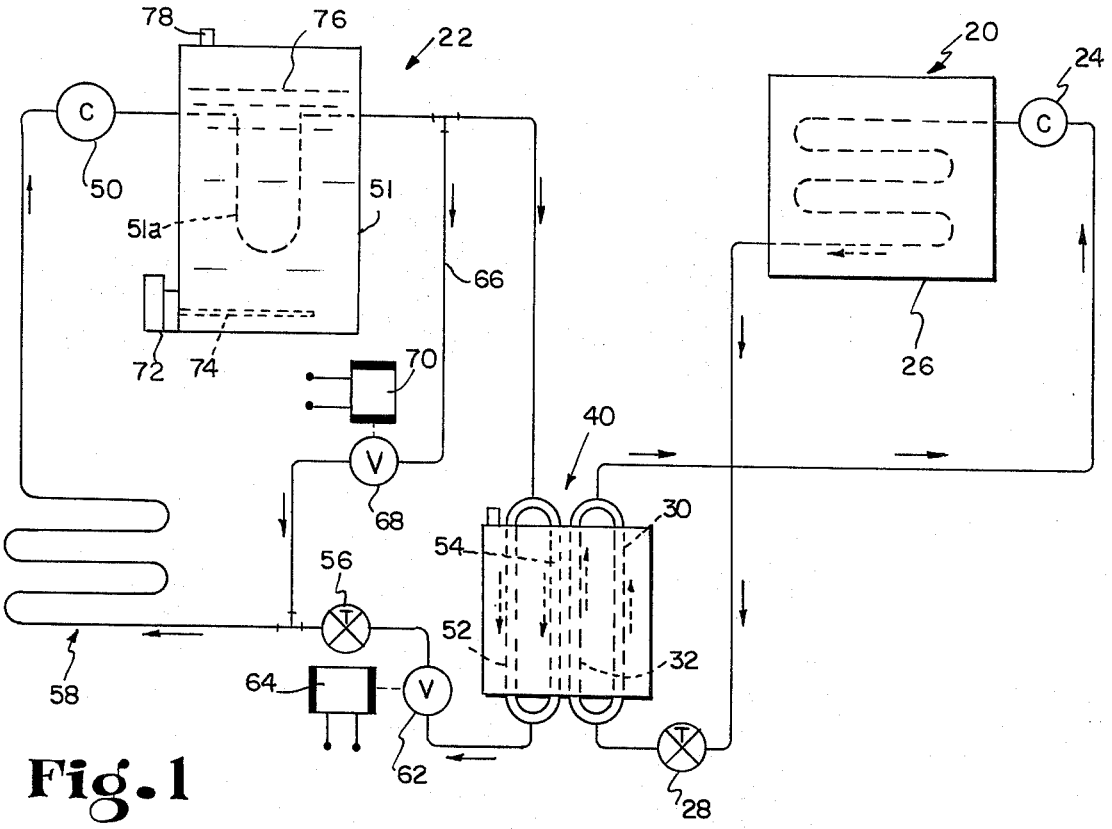

The present invention relates to refrigeration systems and more particularly to the provision of heat exchangers or heat exchange means for providing an operative thermal connection between various portions of a refrigeration circuit or two refrigeration circuits of a cascade system.

It is my concept to provide heat exchanging means including container means filled with a convection fluid with the container means enclosing a portion of the refrigeration circuit such as the condenser of the circuit or the conduit means between the compressor and the condenser.

Simultaneously herewith I am filing another patent application Ser. No. 553,553, filed Feb. 27, 1975 titled "*Cascade Refrigeration System with a Heat Exchanger Filled with Convection Fluid*" disclosing and claiming my concept of using such a heat exchanger to provide an operative thermal connection between the evaporator of the high-stage circuit and the condenser of the low-stage circuit. In this application, I also disclose and claim such cascade systems with such heat exchangers and with other modifications as described herein.

I refer to my U.S. Pat. No. 2,739,453 issued Mar. 27, 1956 and showing a heat exchanger 21 between the evaporator of a high-stage circuit and the condenser of a low-stage circuit as well as to my U.S. Pat. No. 3,491,544 issued Jan. 27, 1970 and showing a condenser 36 serving as a heat exchanger between the evaporator of the high-stage circuit and the condenser of the low-stage circuit. These two types of heat exchangers, I believe, represent the type of heat exchangers presently known and over which my present invention constitutes an improvement. The heat exchanger of U.S. Pat. No. 2,739,453 shows a coiled outer conduit 24 serving as an evaporator through which the refrigerant from the high-stage circuit flows. A smaller conduit means 25 is coiled axially through the coiled conduit means 24 to conduct the refrigerant of the low-stage second system 23. In the system of my patent 3,491,544, the evaporator coils 25 of my high-stage system 10 are disposed in an insulated vertically extending chamber 46 into the upper end of which refrigerant from the low-stage compressor is admitted and from the lower end of which condensed low-stage refrigerant is discharged.

In one embodiment of my present invention, I not only have such a liquid convection fluid heat exchanger providing a thermal connection between the evaporator of the high-stage circuit and the condenser of the low-stage circuit, I have a liquid convection fluid filled heat exchanger disposed between the low-stage compressor output and the low-stage condenser input, and I also have preferably means for selectively heating the convection fluid in the container. I then provide an additional conduit means providing a connection between the low-stage condenser input and the low-stage evaporator input to serve as a by-pass for the low-stage condenser. I provide valve means for controlling the flow of refrigerant through this by-pass such that the refrigerant leaving the compressor will flow through the heat exchanger and then through the by-pass or additional conduit means to the evaporator of the low-stage circuit and then back to the compressor. By doing this, I can eliminate the cycling of the compressor on and off as required by the temperature of the evaporator and I can also provide hot gas flowing through the evaporator to defrost it.

In another embodiment of the present invention, which is not necessarily a cascade refrigeration system, I place such a heat exchanger container filled with liquid convection fluid between the compressor output and the condenser input so that the refrigerant flowing from the compressor to the condenser will pass through the heat exchanger and then I provide a by-passing conduit means connected between the condenser output and the compressor input to by-pass the evaporator with a portion of that additional conduit means also being enclosed in the heat exchanger. I provide valve means for controlling the flow of refrigerant through the additional conduit means. By operating my valve means, I can direct the flow of the refrigerant from the condenser back through the heat exchanger to pick up the heat therein. In other words, I am using the heat exchanger as a dummy load or a heat load to prevent short cycling of the compressor when the evaporator is not calling for cooling.

Finally, in another embodiment of my present invention, which is a cascade refrigeration circuit, I provide the heat exchanger filled with convection fluid and enclosing the evaporator of the high-stage circuit and the condenser of the low-stage circuit and also enclosing a portion of additional conduit means which I use to by-pass the evaporator of the low-stage circuit. With this embodiment, I also provide valve means for controlling the flow through the additional or by-passing conduit means. When the evaporator of the low-stage circuit is not calling for cooling, I can direct the refrigerant flow through the by-passing conduit means to keep from short cycling the compressor.

Other objects and features of my present invention will become apparent as this description progresses.

To the accomplishment of the above and related objects, this invention may be embodied in the forms illustrated in the accompanying drawings, attention being called to the fact, however, that the drawings are illustrative only, and that changes may be made in the specific constructions illustrated and described, so long as the scope of the appended claims is not violated.

Figure 2:
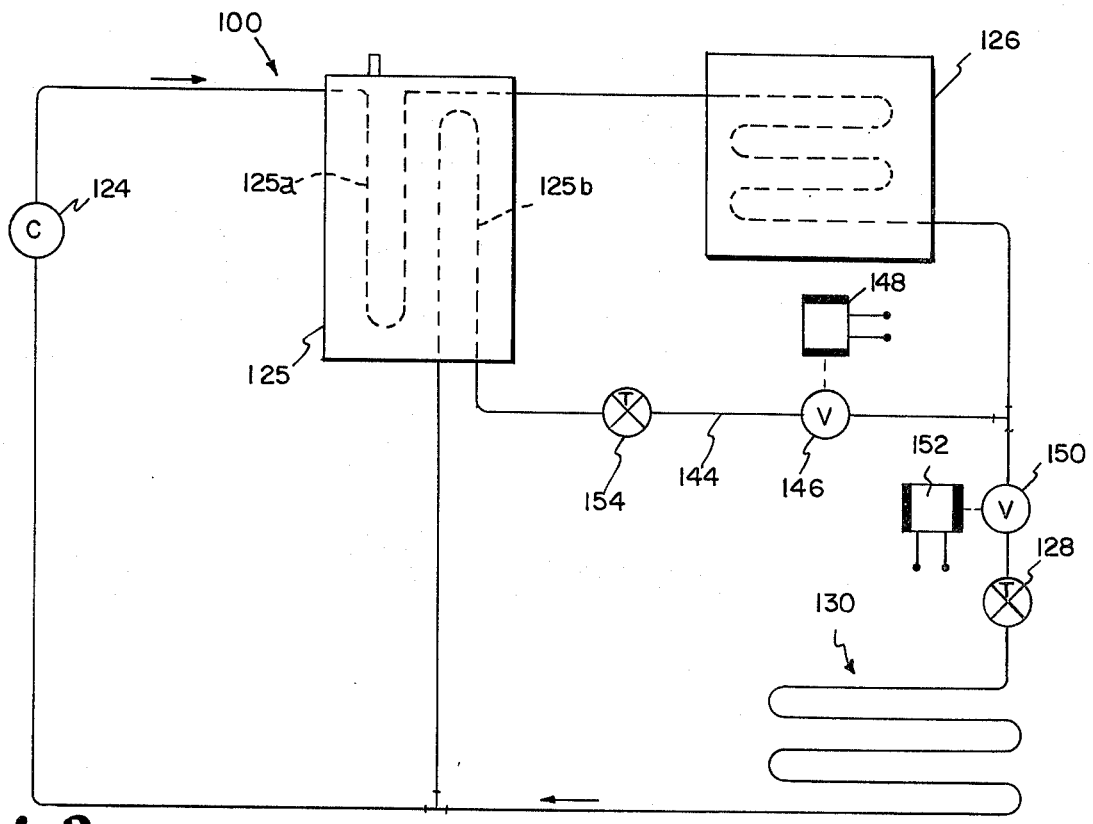
Figure 3:
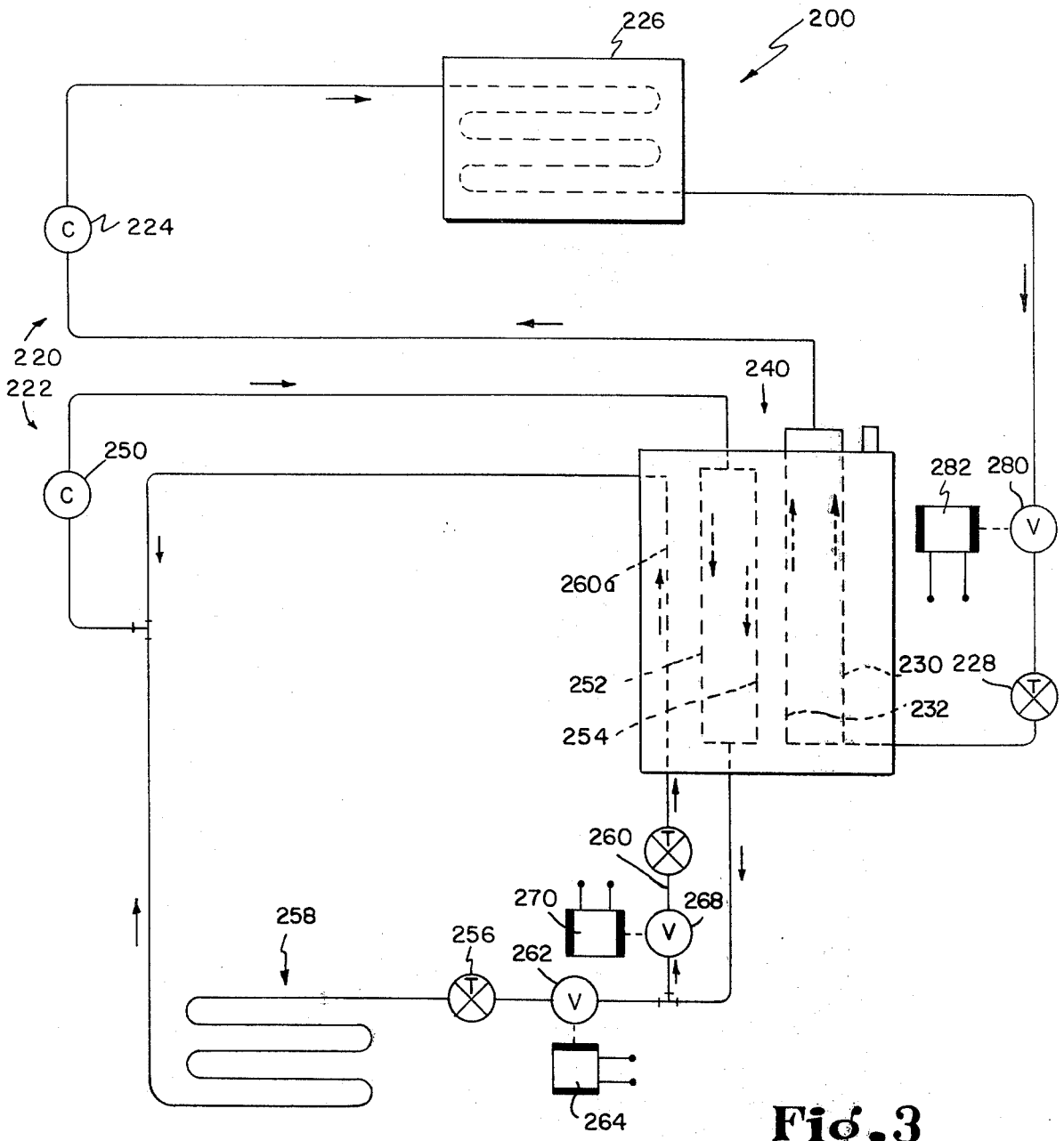

In the drawings:

FIG. 1 is a diagrammatic view of a cascade refrigeration system showing the basic components thereof and showing also two of my heat exchanger means filled with convection fluid used in the system;

FIG. 2 is a diagrammatic view of a single-stage refrigeration circuit showing the basic components thereof together with my heat exchanger disposed between the compressor and the condenser; and FIG. 3 is another diagrammatic view showing a cascade refrigeration circuit with my heat exchanger enclosing the evaporator of the high-stage circuit and the condenser of the low-stage circuit as well as a portion of conduit means which by-passes the low-stage evaporator.

Referring first to FIG. 1, it will be seen that I have shown very diagrammatically a cascade refrigeration system comprising a high-stage refrigeration circuit 20 and a low-stage circuit 22. The high-stage circuit 20 comprises a compressor 24, condenser 26 which may be a water-cooled condenser or an air-cooled condenser, a thermostatic expansion valve 28, and conduits 30, 32 serving as the high-stage evaporator. Refrigerant flows from the compressor 24 through the condenser 26 and expansion valve 28 and then vertically upwardly through the conduits 30, 32 to return to the compressor 24. Such condenser 26 and the expansion valve 28 and the compressor 24 are all well known items which are commercially available and which need not be explained in detail herein.

The reference numeral 40 indicates generally the heat exchanger of my present invention and one of the two heat exchangers in the embodiment of FIG. 1. The low-stage circuit 22 comprises a compressor 50, another heat exchanger container 51 with a conduit portion 51*a* extending therethrough as illustrated, conduits 52, 54 serving as the condenser for the low-stage circuit, a thermostatic expansion valve 56, and an evaporator 58. The refrigerant flows from the compressor 50 through the conduit portion 51*a* of the heat exchanger 51 through the condenser tubes 52, 54 and the expansion valve 56 to the evaporator 58 and then back to the compressor 50.

It is my concept to enclose the tubes 30, 32, 52, 54 in a container such as illustrated and to fill that container with a convection fluid which will have a freezing point significantly lower than the freezing point of the refrigerant in the high-stage circuit 20. It is not necessary, of course, to have two evaporator tubes 30, 32 and two condenser tubes 52, 54. This tube arrangement is merely illustrative, and I may use all sorts of conduit arrangements within the container of the heat exchanger 40. I have merely found it convenient to bring the refrigerant through the expansion valve 28 and to divide it for vertical movement upwardly through the two tubes 30, 32 and then to bring the refrigerant from the compressor 50 and the heat exchanger 51 to the heat exchanger and to divide it for movement vertically downwardly through the two tubes 52, 54.

In the illustrative embodiment of FIG. 1, I provide a valve 62 operated by a solenoid 64 at the output of the low-stage evaporator and then I provide an additional conduit or by-passing conduit 66 between the input of the low-stage condenser and the input of the low-stage evaporator 58 serving as a by-pass for the low-stage condenser. This by-pass conduit includes a valve 68 operated by a solenoid 70.

Under normal operation of the cascade refrigeration system of FIG. 1, the refrigerant will flow from the compressor 50 through the tubes 52, 54 and the evaporator 58 back to the compressor. By closing the valve 62 and opening the valve 68, I can by-pass the tubes 52, 54 or the low-stage condenser to direct the hot gas from the heat exchanger conduit portion 51*a* through the evaporator 58 to heat and defrost the evaporator without turning off the compressor 50. I may even provide a thermostat 72 which controls a heater 74 within the container 51 to add additional heat to the convection fluid, the upper level of which is indicated at 76. A tap 78 is provided for adding convection fluid to the container 51.

As a specific illustration of a cascade refrigeration system in accordance with the FIG. 1 diagram, assume that the high-stage circuit 20 is charged with Freon 502 while the low-stage circuit 22 is charged with Freon 503. The characteristics of these refrigerants Freon 502 and 503 are well known. By way of example only, with such a refrigerant charge in the two circuits 20, 22, the compressor 24 will supply at its output hot refrigerant gas at a temperature range of, for instance, 190° to 210° F. to be liquefied in the condenser 26 and raised, for instance, to ambient or about 75° F. Then the temperature of the refrigerant leaving the expansion valve 28 would be about, for instance, −40° F. with the temperature of the refrigerant leaving the upper end of the tubes 30, 32 and heading back to the compressor being about 0° F. Then, the low-stage circuit compressor will provide an output of hot gas at a temperature, for instance, between 190° and 210° F. which will flow through the heat exchanger 51 to raise the temperature of the convection fluid therein to approximately 200° F. This hot gas will flow on to the condenser tubes 52, 54 to be liquefied and reduced to a temperature of, for instance, −40° F. As the refrigerant flows on past the expansion valve 56, its temperature will be lowered to, for instance, −125° F. to flow through the evaporator 58. The temperature of the refrigerant leaving the evaporator 58 will be in the neighborhood of 0° F. If it is desired to heat up the evaporator 58, the solenoid valve 62 is closed and the valve 68 is open so that the hot refrigerant leaving the heat exchanger conduit portion 51*a* or picking up the heat contained in the convection fluid in the heat exchanger will flow through the evaporator 58. When needed, I can even add heat to the convection fluid within the heat exchanger by the thermostat 72 controlled heater 74.

Turning now to FIG. 2, it will be seen that there is a refrigeration circuit 100 comprising a compressor 124, a heat exchanger 125, a condenser 126, an expansion valve 128, and an evaporator 130 with the compressor, condenser and evaporator being conventionally connected together in a phase-change refrigeration circuit. The addition of the heat exchanger 125 between the output of the compressor 124 and the input of the condenser 126 constitutes my improvement. A portion 125*a* of the conduit between the compressor 124 and the condenser 126 is enclosed in the heat exchanger 125 to be in heat-conducting relation to the convection fluid therein. I then provide an additional conduit means or a by-pass conduit means 144 leading from the output of the condenser 126 to the input of the compressor 124 with this by-passing conduit means having a portion 125*b* also enclosed in the heat exchanger 125 to be in heat-conducting relation to the convection fluid therein. I place a valve 146 in this by-passing conduit means which is controlled by solenoid 148 and I place another valve 150 between the condenser 126 and the input of the evaporator 130 with a solenoid 152 controlling the valve 150. By closing the valve 150 and opening the valve 146, I can direct the flow of refrigerant from the condenser 126 through a thermostatic expansion valve 154 and then through the conduit portion 125*b* on to the compressor 124, thereby by-passing the evaporator 130 when the evaporator 130 is not calling for cooling. I am, therefore, using the heat exchanger 125 as a heat load having a temperature up to 200° F. or more for the refrigerant leaving the condenser 126 and flowing toward the compressor 124. Thus, I have a system which will eliminate the requirement for cycling the compressor 124 on and off which is detrimental to the compressor. When the evaporator 130 is not calling for cooling, I can simply direct the refrigerant leaving the condenser 126 back through the heat exchanger 125 and then to the compressor 124 which continues to run. The control of this is accommodated by the solenoid valves 146, 150.

Assuming that the circuit of FIG. 2 is charged with Freon 502, the hot gas leaving the compressor 124 will be between, for instance, 190° and 210° F. to heat the convection fluid within the heat exchanger 125 to that temperature range. The refrigerant leaving the condenser 126 will be approximately at the ambient temperature range while the temperature of the refrigerant leaving the expansion valve 128 will be approximately −40° F.

Referring now to the embodiment of FIG. 3, it will be seen that I have illustrated another cascade refrigeration system 200 comprising a high-stage circuit 220 and a low-stage circuit 222. The high-stage circuit has a compressor 224, condenser 226, expansion valve 228, and evaporator tubes 230, 232 disposed within the liquid convection fluid filled container of the heat exchanger 240.

The low-stage circuit includes a compressor 250, condenser tubes 252, 254, expansion valve 256 and evaporator 258. The condenser tubes 252, 254 are enclosed in the heat exchanger 240 container to be submerged in the liquid convection fluid with the tubes 230, 232. I then provide a by-pass conduit 260 connected between the output of the low-stage condenser tubes 252, 254 and the input of the compressor 250 to by-pass the evaporator 258. A solenoid valve 268 is disposed in the conduit 260 and controlled by a solenoid 270 while the input to the evaporator 258 may be blocked by another solenoid valve 262 controlled by solenoid 264. A portion 260*a* of the by-pass conduit 260 also is enclosed within the heat exchanger container to be in heat-conducting relation with the liquid convection fluid therein.

The embodiment of FIG. 3 is such that I can by-pass the evaporator 258 by closing the valve 262 and opening the valve 268, thereby providing for precision temperature control and conserving energy by eliminating cycling of the compressor 250. The compressor 250 can run continuously even though the evaporator 258 is not calling for chilling and such an operation will continue to cool the convection fluid in the heat exchanger.

I show valve 280 controlled by solenoid 282 for safety purposes not having anything to do with the present invention.

I may use several different types of liquid convection fluid. I might use, for instance, and R-11 refrigerant having a boiling point of approximately +75° F. and a freezing point of approximately −168° F. as a convection fluid for one of my embodiments. I prefer that the liquid convection fluid have a freezing point significantly lower than the freezing point of the high-stage refrigerant. I prefer that the convection fluid remains in a liquid state. The "R" designation is a designation adopted by the American Society of Heating, Refrigerating and Air-Conditioning Engineers (ASHRAE). There are several other convection fluids I might use such as 50% Ethylene glycol, Trichloroethylene, Lexsol 408, Acetone, Methylene Chloride, Methyl Alcohol, Ethanol and even R12 refrigerant. The boiling points and freezing points of all such materials are well known. For both embodiments of FIGS. 2 and 3, I may use, for instance, Methylene Chloride or equal.

I claim:

1. In a phase-change refrigeration circuit including a compressor, condenser and evaporator and connecting conduit means charged with a phase-change refrigerant, each of said compressor, condenser and evaporator having an output and input, the improvement comprising a heat exchanger, said heat exchanger including container means filled with a liquid convection fluid, said container means enclosing a portion of said circuit such that said convection fluid is in heat-conducting relation to the system refigerant flowing through said portion, said container means being disposed between the compressor output and condenser input to enclose a portion of the conduit means extending therebetween, and additional conduit means providing a connection between the condenser output and compressor input to by-pass said evaporator, a portion of said additional conduit means being enclosed by said container means to have the refrigerant flowing therethrough in heat-conducting relation to said convection fluid, and valve means for controlling the flow of refrigerant through said conduit means and said additional conduit means.

2. The improvement of claim 1 in which said valve means includes solenoid valves effective, when actuated, to close the conduit means from the condenser output to the evaporator input and to open said additional conduit means.

3. In a phase-change refrigeration circuit including a compressor, condenser and evaporator and connecting conduit means charged with a phase-change refrigerant, each of said compressor, condenser and evaporator having an output and input, the improvement comprising a heat exchanger, said heat exchanger including container means filled with a liquid convection fluid, said container means enclosing a portion of said circuit such that said convection fluid is in heat-conducting relation to the system refrigerant flowing through said portion, said refrigeration circuit being the low-stage circuit for a cascade refrigeration system including a high-stage circuit having a compressor, condenser and evaporator and connecting conduit means charged with a phase-change refrigerant, each of the last said compressor, condenser and evaporator having an inlet and outlet, said container means being disposed between the low-stage compressor output and condenser input to enclose a portion of the conduit means extending therebetween, and additional conduit means providing a connection between the low-stage condenser input and the low-stage evaporator input to by-pass the low-stage condenser, and valve means for controlling the flow of refrigerant through said additional conduit means.

4. The improvement of claim 3 including means for selectively heating said convection fluid in said container means.

5. The improvement of claim 3 including a second container means enclosing the evporator of said high-stage circuit and the condenser of said low-stage circuit, said second container means being filled with a liquid convection fluid having a freezing point significantly lower than the refrigerant in said high-stage circuit.

6. In a cascade refrigeration system comprising a high-stage phase-change refrigeration circuit and a low-stage phase-change refrigeration circuit, each circuit comprising a compressor, condenser and evaporator charged with a phase-change refrigerant, the improvement comprising a container enclosing the evaporator of said high-stage circuit and the condenser of said low-stage circuit, said container being filled with a convection fluid in heat-conducting relation to said high-stage evaporator and said low-stage condenser, said convection fluid remaining in a liquid state and said convection fluid having a freezing point significantly lower than the freezing point of the high-stage refrigerant, additional conduit means for connecting the low-stage condenser output to the low-stage compressor input to by-pass the low-stage evaporator, and valve means for controlling flow of refrigerant through said additional conduit means, and a portion of said additional conduit being enclosed in said container means to be in heat-conducting relation to said convection fluid therein.

7. In a phase-change refrigeration circuit including a compressor, condenser and evaporator and connecting conduit means charged with a phase-change refrigerant, each of said compressor, condenser and evaporator having an output and input, the improvement comprising a heat exchanger, said heat exchanger including container means filled with a liquid convection fluid, said container means enclosing a portion of said circuit such that said convection fluid is in heat-conducting relation to the system refrigerant flowing through said portion, said refrigeration circuit being the low-stage circuit of a cascade refrigeration system, said container means enclosing the condenser of said circuit, additional conduit means providing a connection between the condenser output and the compressor input to by-pass the evaporator, a portion of said additional conduit means being enclosed in said container means to have the refrigerant flowing through said additional conduit means portion in heat-conducting relation to said convection fluid, and valve means for controlling the flow of refrigerant through said additional conduit means.

8. In a phase-change refrigeration circuit including a compressor, condenser and evaporator and connecting conduit means charged with a phase-change refrigerant, each of said compressor, condenser and evaporator having an output and input, the improvement comprising a heat exchanger, said heat exchanger including container means filled with a liquid convection fluid, said container means enclosing a portion of said circuit such that said convection fluid is in heat-conducting relation to the system refrigerant flowing through said portion, said liquid convection fluid having a freezing point lower than the freezing point of water, and said convection fluid remaining in its liquid state throughout the cycling of said refrigeration circuit, said container means being disposed between the compressor output and the condenser input to enclose a portion of the conduit means extending therebetween.

9. The improvement of claim 8 including means for selectively heating said convection fluid in said container.

10. The improvement of claim 8 including additional conduit means connected between the condenser input and the condenser output to provide a by-pass for the condenser, and valve means for controlling the flow of refrigerant through said additional conduit means.

* * * * *